US010011340B2

(12) United States Patent
Gai et al.

(10) Patent No.: US 10,011,340 B2
(45) Date of Patent: Jul. 3, 2018

(54) STREERING DEVICE FOR MARINE VESSELS

(71) Applicant: ULTRAFLEX S.P.A., Casella (GE) (IT)

(72) Inventors: Marcella Gai, Busalla (IT); Federico Tralongo, Busalla (IT)

( * ) Notice: Subject to any disclaimer, the term of this patent is extended or adjusted under 35 U.S.C. 154(b) by 0 days.

(21) Appl. No.: 15/436,756

(22) Filed: Feb. 17, 2017

(65) Prior Publication Data

US 2017/0240260 A1 Aug. 24, 2017

(30) Foreign Application Priority Data

Feb. 19, 2016 (IT) ..... 102016000017261

(51) Int. Cl.

| | |
|---|---|
| ***B63H 20/12*** | (2006.01) |
| ***B63H 20/10*** | (2006.01) |
| ***B63H 25/02*** | (2006.01) |
| ***B63H 25/06*** | (2006.01) |

(52) U.S. Cl.

CPC ..... *B63H 20/12* (2013.01); *B63H 20/10* (2013.01); *B63H 25/02* (2013.01); *B63H 25/06* (2013.01); *B63H 2025/022* (2013.01)

(58) Field of Classification Search

CPC ..... B63H 25/00; B63H 25/02; B63H 25/06; B63H 25/08; B63H 25/10; B63H 25/12; B63H 25/22; B63H 25/24; B63H 20/10; B63H 20/12

USPC ..... 114/144 R, 144 RE; 74/493

See application file for complete search history.

(56) References Cited

U.S. PATENT DOCUMENTS

| | | | | |
|---|---|---|---|---|
| 2,826,090 A * | 3/1958 | Grinnell | ..... | B63H 25/08 74/493 |
| 2,926,545 A | 3/1960 | Loeffler | | |
| 3,395,930 A * | 8/1968 | Morgan | ..... | B62D 1/10 74/493 |
| 5,136,894 A * | 8/1992 | Carter | ..... | B63H 25/10 114/144 R |
| 5,676,081 A * | 10/1997 | Kobelt | ..... | B63H 25/12 114/144 R |

(Continued)

FOREIGN PATENT DOCUMENTS

EP 1510453 3/2005

*Primary Examiner* — Lars A Olson
(74) *Attorney, Agent, or Firm* — Themis Law

(57) ABSTRACT

The invention relates to a steering control device for boats that includes a drive shaft, the rotation of which in one direction or in the opposite direction, by way of a control member, such as a steering wheel or helm mounted or mountable thereon, causes a steering input for an outboard motor or rudder. The steering input is generated by a transmission member, housed into a case, configured to transmit the rotational motion of the shaft to an actuator, associated or associable to the motor or rudder, through a transmission circuit. The device includes a first stationary part configured to be fastened on the bridge of the boat and a second movable part integral with the case of the transmission member. The drive shaft and the transmission member are coupled such that the change in the tilt of the shaft by a given angle causes a change in the tilt of the transmission member by the same angle with a corresponding change in the tilt of the case of the transmission member with respect to the stationary part of the device.

15 Claims, 6 Drawing Sheets

(56) References Cited

U.S. PATENT DOCUMENTS

| | | | | |
|---|---|---|---|---|
| 7,137,347 | B2 * | 11/2006 | Wong | B63H 25/24<br>114/144 R |
| 7,302,899 | B2 * | 12/2007 | Zeiger | B63H 25/02<br>114/144 R |
| 2005/0166819 | A1 | 8/2005 | Zeiger | |
| 2006/0118022 | A1 | 6/2006 | Sasayama | |

* cited by examiner

STREERING DEVICE FOR MARINE VESSELS

FIELD OF THE INVENTION

The present invention relates to the field of steering control systems for boats, watercrafts or the like.

BACKGROUND OF THE INVENTION

These systems comprise a steering member, such as for example a steering wheel or helm, whose rotation causes the corresponding rotation of a drive shaft of a control pulse or signal generating device which is typically housed in a case from which said drive shaft protrudes and that by means of a transmission circuit, transmits the generated pulses or signals corresponding to the rotational motion of the shaft to an actuator, associated with the motor and/or rudder or other units that change the direction of a watercraft.

In hydraulic systems, the rotation of the drive shaft causes a displacement of a pressurized fluid, in one direction or in the opposite direction, depending on the rotation of the steering wheel and which fluid is supplied to a hydraulic cylinder through a hydraulic circuit.

The pressurized fluid is supplied by a system of distributor valves to each one of the two ports respectively of a double-acting hydraulic cylinder that, therefore, moves along a rod, kept stationary between two fixed points connected to its ends, in a direction or in the opposite direction depending on the rotational direction of the drive shaft of the pump. The cylinder is in turn connected by means of linkages to a steering arm, for example of a marine outboard motor or to a control lever of a rudder.

In mechanical systems, the pump is replaced by rotary or rectilinear mechanical steering systems which move one or two steel cables, which is/are connected by linkages to a steering control element, which is moved in one or the other opposite direction depending on the direction of rotation of the drive shaft of the steering systems.

In electric/electronic systems the rotation of the drive shaft is read by electromechanical, electronic, magnetic, optical transducers or by combinations of such transducers which generate electromagnetic or possibly also optical signals uniquely related to the angle position and the direction of rotation of the drive shaft.

An electronic control unit manages communications among the several components of the watercraft through communication lines, with a predetermined protocol for coding and transmitting signals, such as for example bus called as CAN-BUS, and interprets and recognizes the signals of the several control members while generating in turn signals operating relevant actuators connected to the members to be controlled, specifically a rudder or an outboard motor.

Electromechanical systems are in the middle between electric and mechanical systems since provide the steering to be always of the mechanical type, that is by tie rods, but using servomechanisms to limit the effort exerted by the user.

Whatever system is used, the components transmitting the motion of the drive shaft are generally housed in a cabinet or compartment placed under the bridge. The control signal or pulse generating device can be arranged with its case at least partially embedded in the bridge or completely embedded in the compartment of the bridge, with the shaft protruding out therefrom for the connection to the wheel.

In known systems, the shaft has a precise inclination with respect to the surface of the bridge such that driving is made comfortable.

However there is the need of changing the tilt angle of the wheel depending on driving characteristics. To this end solutions have been suggested that use a universal joint coupling the hub of the steering wheel or helm to the drive shaft according to variable directions thus realizing the so called tilt of the steering wheel or helm.

Therefore the joint of known solutions is interposed between the drive shaft and the steering wheel and it causes not only the distance between the steering wheel and the bridge to be extended, since the universal joint is a kind of extension of the drive shaft, but it also generates, due to the possibility of tilting the output axis and the input axis with each other, elbows that make uncomfortable to turn the wheel, since the hub of the steering wheel is not more centered with the drive shaft and since the axis of the hub of the steering wheel and the one of the shaft are not more aligned with each other.

Moreover, although such solutions accomplish their functions even if with the above mentioned restrictions, they also have the drawback of requiring an additional component (the universal joint) to be fitted on the dashboard between the drive shaft and the steering wheel with the case of the transmission member completely arranged underneath the bridge. This leads to considerable encumbrance both on the part above the bridge, due to the presence of the universal joint, and also under the bridge where the case of the transmission member is completely housed.

SUMMARY OF THE INVENTION

Therefore the aim of the present invention is to provide a watercraft steering control device for tiltable control members, that is simple, cheap and with reduced encumbrance and that overcomes above drawbacks of known devices.

The invention achieves the aim by a watercraft steering control device as described hereinbefore wherein the assembly of drive shaft and control signal or pulse generating device is mounted so as to tilt about at least one axis perpendicular to the axis of rotation of the drive shaft and/or parallel to the bridge by means of at least a pair of coaxial and diametrically opposite tilting pivots between said assembly and a structural element of the bridge.

One non limitative embodiment provides also the case housing the drive shaft and control signal or pulse generating device assembly to be tiltable together with said drive shaft and control signal or pulse generating device assembly, the at least two tilting pivots diametrically opposite with each other being provided between said case and said structural element of the bridge.

Constructional specifications of tilting pivots can be any and are part of the opportunity choices made by the person skilled in art, in order to meet contingent structural needs and shape needs, within the alternative technical solutions that belong to his/her basic technical knowledge.

Thus for example the case housing the assembly composed of the drive shaft and the device generating control pulses or signals can have in diametrically opposite points thereof seats fastening two spindles radially protruding out from said case to a predetermined extent and arranged coaxial and diametrically opposite with each other, which spindles are rotationally engaged in support seats fastened to a structural element of the bridge, such as for example the inner side of the wall of the bridge intended to receive said assembly.

Advantageously, when at least only one tilt axis is provided said axis is oriented in a direction transverse to the longitudinal direction of the boat or to the straight forward direction such to allow the steering wheel to be tilted forwards and backwards that in case of an inclined bridge provides also a vertical movement component of the steering wheel.

A particularly advantageous alternative as regards the possibility of extending the function of the tilt of the steering wheel also to devices generating control signals or pulses already existing or produced according to specifications or designs already present, provides an additional tilt member connectable on demand to the case of the drive shaft and control pulse or signal generating device assembly which tilt member comprises a part intended to be fastened to said case and a part intended to be fastened to a structural element of the bridge, between said two parts two relative pivot points being provided in a position diametrically opposite and coaxial with each other.

Particularly according to one embodiment the tilt member comprises a first stationary part intended to be fastened to the bridge of the boat, at an opening housing the case of the assembly of drive shaft and control pulse or signal generating device and a second movable part integral, by being fastened or made as a single piece with the case of the assembly of drive shaft and control pulse or signal generating device, said two parts being articulated with each other such to define a tilt axis for the case with respect to the bridge that is oriented substantially perpendicular to the axis of rotation of the drive shaft.

Advantageously in all the possible variants a position locking mechanism is provided, which can be manually activated or deactivated, such as for example a brake or axial pins or teeth cooperating with corresponding engagement seats or crowns of engagement seats coaxial to the tilt axis and one being provided on the part fastened to the structural element of the bridge and the other one on the assembly of drive shaft and control pulse or signal generating device, or on the case of such assembly or on the part intended to be fastened to said case.

Particularly one embodiment provides at one of the two diametrically opposite pivot regions two crowns of front teeth opposite to each other and coaxial to the tilt axis and which crowns are movable by means of screw clamping means in an interference position or in a non-interference position, thus stopping or releasing the tilt.

Still according to a further characteristic said oscillation axis, namely said tilt axis is provided in the area of the rear half of the case, that is the half of the case opposite to the one on the side of the drive shaft.

Still according to a further characteristic the tilt axis is provided in the region of a rear end portion of said rear half of the case.

In a preferred embodiment the tilt axis is provided in such a position with respect to the rear side of the case, that the rear end of the case protrudes inside the opening of the bridge such that, the connection regions of the transmission circuit or transmission elements are inside the compartment of the bridge in any tilt position.

As an alternative it is also possible that in the two limit tilt positions on the contrary access windows, filling ports or members adjusting the steering system can be made as accessible from the outside of the bridge, such to allow controls and/or replacements/repairs.

Advantageously, the assembly composed of the drive shaft, the control pulse or signal generating device and the case are coupled with each other such that the change in the tilt of the shaft by a given angle causes a change in the contemporaneous tilt of the control pulse or signal generating device by the same angle with a corresponding change in the tilt of the case with respect to the surface of the bridge or other reference direction.

In the variant where the tilt axis is provided in the position displaced towards the rear end of the case, it is possible to considerably reduce encumbrance. The tilt mechanism is in practice integrated with said case making the latter movable such to follow the inclination of the drive shaft set by the tilt of the steering wheel or helm directly connected to the shaft.

Making all said assembly and particularly the drive shaft as tiltable, the latter remains coaxial to the wheel hub directly fastened thereto therefore drawbacks and inconveniences that are typical of the universal joint described above are overcome.

Moreover the advantages are not only from a functional point of view, but the steering control device is very compact and with a limited encumbrance both above the bridge and inside it regardless of the type of mechanisms used for converting in a steering input the rotational motion of the steering wheel or helm connected to the device.

When the device is mounted on the bridge of a boat, the case of the transmission member is variously housed in said bridge depending on the tilt angle due to the fact that it correspondingly changes its inclination.

Still according to a further embodiment, the device provides a first stationary element like a frame, preferably with annular shape, which first element is intended to be fastened at an opening with a corresponding shape formed in the upper wall of a bridge, and said frame-like stationary element is provided with through holes in diametrically opposite positions, preferably according to a direction perpendicular to the longitudinal direction of the boat.

In its smallest variant the stationary element associated to the assembly composed of the case of the transmission member, the transmission member and the shaft is composed of at least two opposite and coaxial seats engaging pins protruding out from diametrically opposite sides of the case, which pins are intended to form the tilt axes and pass each one in a corresponding hole provided in the stationary element fastened to the bridge, while there are provided removably locking means allowing the assembly to be locked in a predetermined tilt position and to unlock the assembly as regards its oscillation about the axis of said pins to change the tilt of the drive shaft.

Several alternative variants are possible. The two pins or at least one of the two pins is made as one piece with the assembly like a projection integral thereto.

Seats of the two pins or at least one seat of the two pins are provided on a second element coupling to the case.

In one embodiment said second element coupling to the case is provided like a coupling frame or ring mountable and fastenable to the case of the control device in a stable or removable manner.

Also in the case of said variants providing a second element fastened or fastenable to the case, variants are possible in which:

Said second element has at least one pin that is integral with said second coupling element and at least one through hole engaging a second pin, or two through holes each one for one of the two pins.

In all said variants it is possible to provide a member locking/releasing the oscillation.

According to a first embodiment said member is composed of a clamping nut screw tightening on the thread of one of the two pins by clamping the external element against the internal element.

Advantageously the region surrounding the hole for the passage of at least one pin and on the first element and the region surrounding the pin on the second element there are provided facing crowns of front teeth that operate by engaging with each other upon the locking clamping action.

According to a variant, the front teeth are provided on a locking spacer like a thick washer or bushing that is fitted on at least one pin in a position interposed between the case or the second element and the first stationary element and which bushing or washer has at least on the side facing said first element the crown of front teeth intended to cooperate with that of said first element.

The clamping nut screw can be advantageously made with a hole engaging the pin of the eccentric type like a handle.

According to another aspect the invention relates to a steering control system for boats, watercrafts or the like comprising a tiltable steering member, such as for example a steering wheel or helm, whose rotation causes the corresponding rotation of a drive shaft of a device according to the invention, which device transmits a steering input to a steering control element, such as a marine outboard motor or a control lever of a rudder, through a transmission circuit, said system being made according to one or more of the characteristics and variants described above.

The invention relates also to a kit comprising a steering control device with a drive shaft fastened to a steering wheel or the like, a steering control pulse or signal generating device driven by said shaft and a housing case holding said elements, and a tilt member comprising two elements pivoted with each other according to a predetermined tilt axis which two elements are fastenable one to said case and the other one to a structural element of the bridge.

Further characteristics and improvements are the subject matter of the dependent claims.

BRIEF DESCRIPTION OF THE DRAWINGS

Features of the invention and advantages deriving therefrom will be more clear from the following detailed description of the annexed drawings wherein.

DETAILED DESCRIPTION OF EMBODIMENTS OF THE INVENTION

Figure 1:
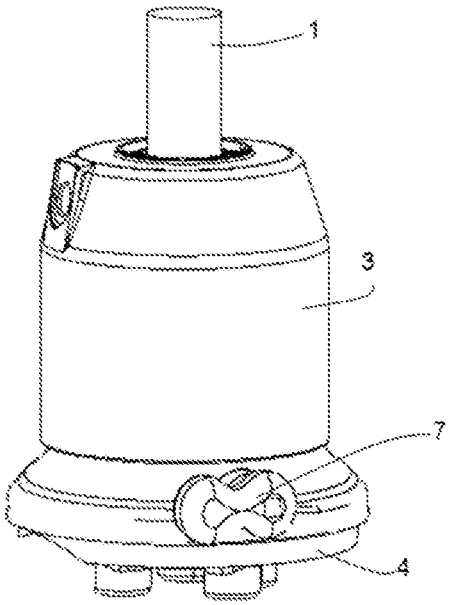
FIG. 1 is a perspective view of the device according to one embodiment of the invention
Figure 2:
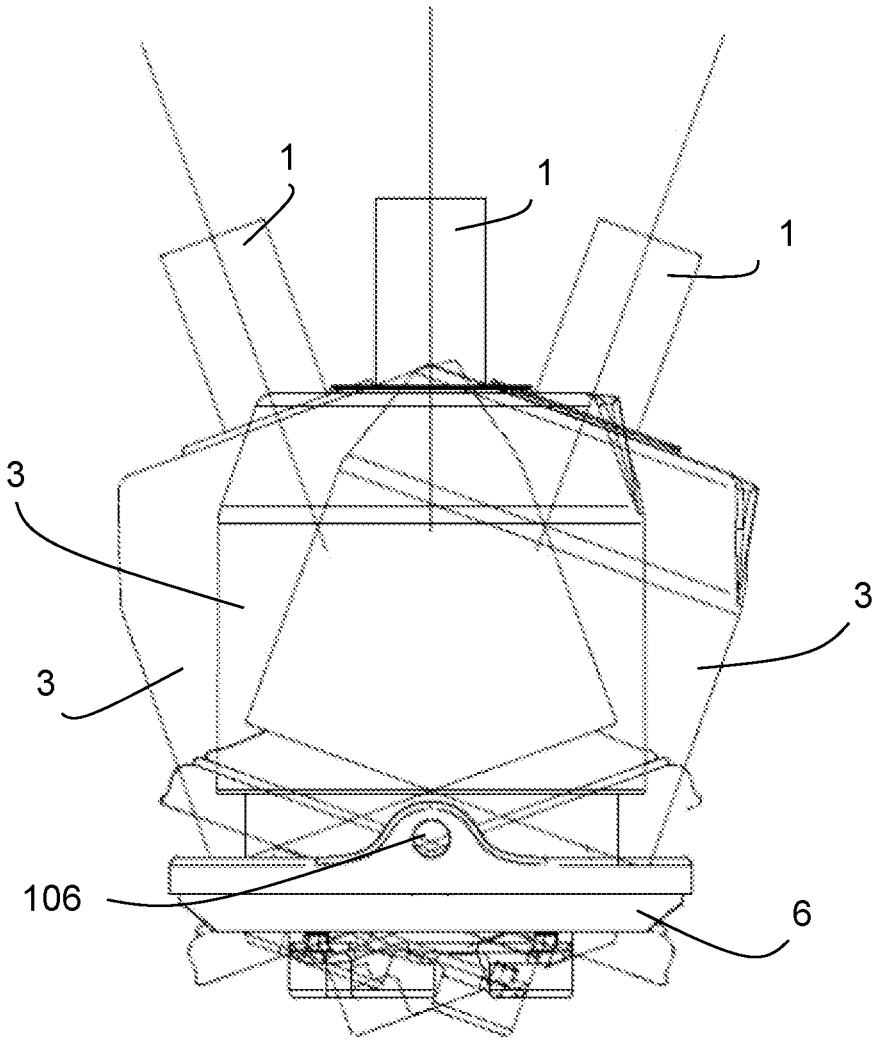
FIG. 2 is a front view of the device of FIG. 1 according to different arrangements, particularly in a vertical position and with tilt of ±20°.
Figure 3:
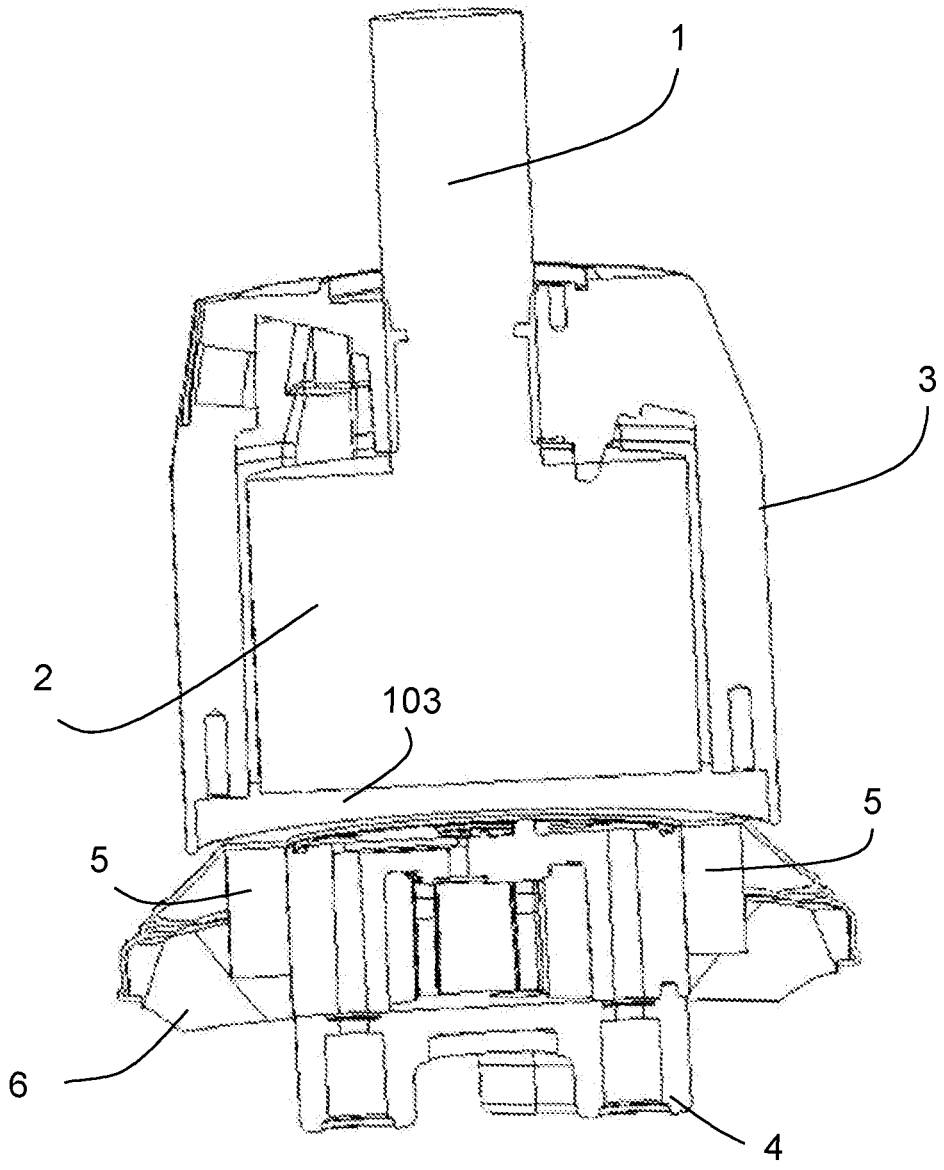
FIGS. 3 and 4 are a longitudinal section, according to a plane perpendicular to the axis of rotation, of the device in the vertical position and with tilt of +20°.
Figure 4:
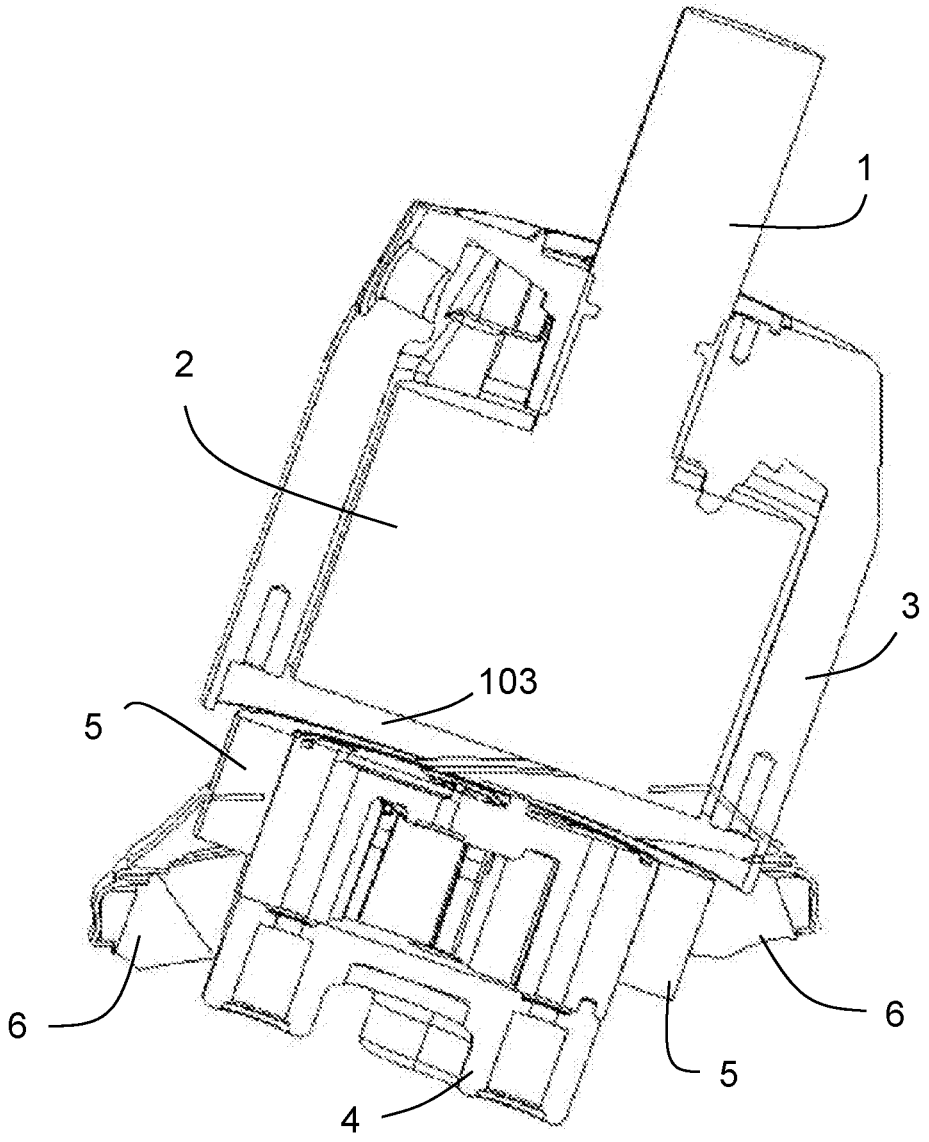
Figure 5:
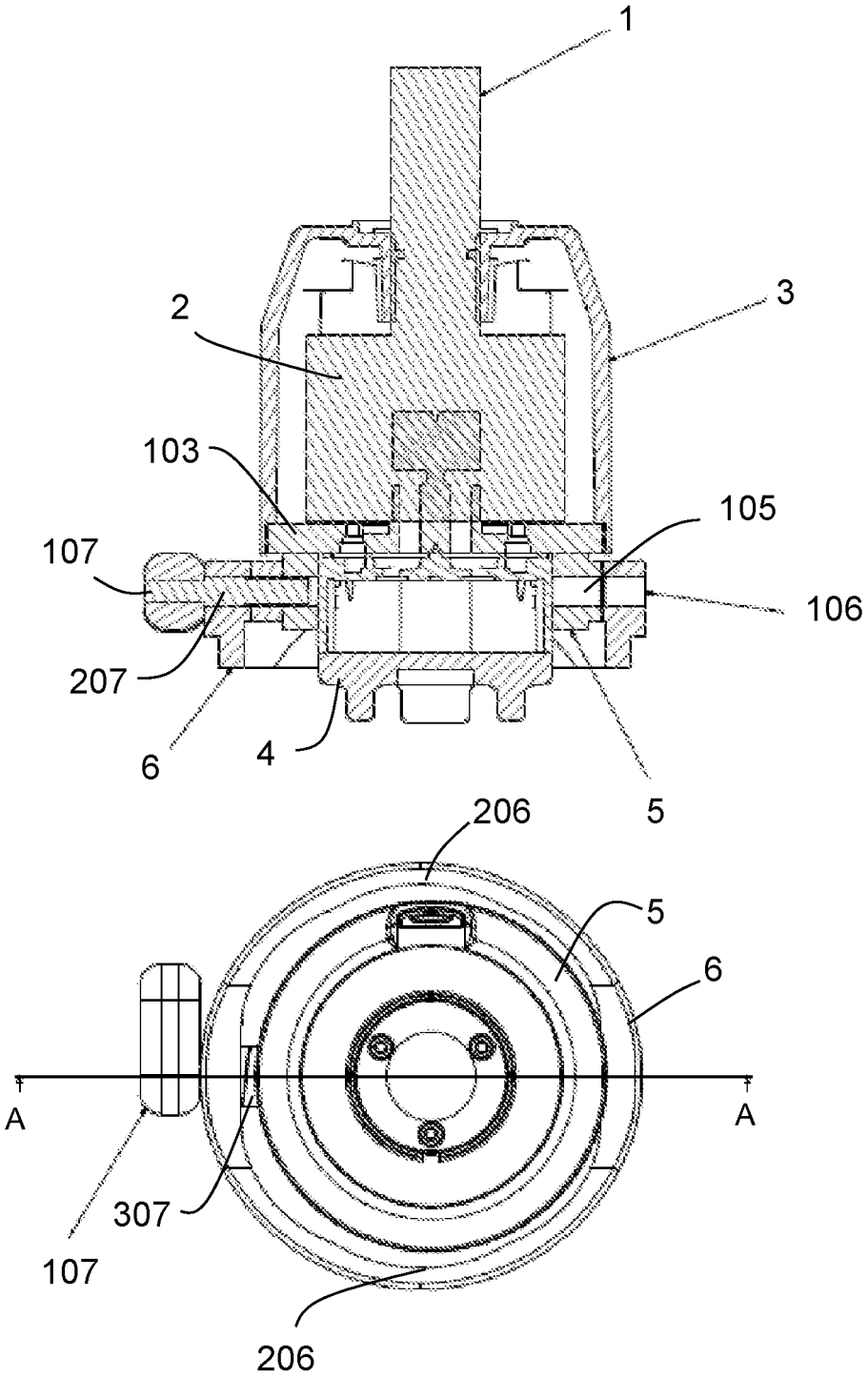
FIG. 5 is a top view and a section view of the device according to a plane passing by the axis of rotation.

The figures show the invention with reference only to the embodiment of a steering control device of the hydraulic type, which is composed of an axial piston pump supplying pressurized oil to the chambers of an actuating cylinder correspondingly to the direction of rotation and to the rotation angle of the steering wheel and therefore of the drive shaft. However, such choice is not be intended to be a limitation, since with clear adjustments the inventive idea can be transferred without any inventive steps also to steering systems having other types of control members such as those described hereinbefore in the present description, that is, mechanical, electromechanical, electrohydraulic and electronic, namely of the so called Steer by Wire type.

Moreover, the shown embodiment provides a control device with an axial piston pump, which is of the conventional type and which is provided in combination with a tilt member applicable to the case of said pump or the distributor valve integrated within said pump. Such embodiment is the most complex, since the tilt member is a tool applicable on demand and must not be considered a limitation for the present invention. As described hereinbefore, the case can be integrated with means for the oscillating fastening to the bridge that can be made according to different variants that are all part of the technical basic knowledge of a person skilled in the art and the specific selection of which falls within the range of normal opportunity choices that the person skilled in the art must perform in the designing phase.

With reference to the figures, a device according to the invention is provided in combination with a steering control device comprising a drive shaft 1 of a pump, whose rotor 2 is housed in a case 3 closed at the bottom by a base of the pump element 103 shaped like a flange for fastening to a valve body 4.

The pump is known and it can be of any type and an embodiment of such pump provides for a rotor having a plurality of axial compression chambers, which surround the drive shaft. A piston is axially slidably housed in each chamber and biased by elastic means with one end projecting out of one end side of the corresponding compression chamber against a cam track consisting of an annular plate inclined with respect to the axis of rotation of the rotor, for example as described in patent application IT GE2013A000088 to the same applicant, which is incorporated by reference in the present description.

The steering control device is mounted in a bridge, partially or completely embedded in a compartment underneath the panel of the bridge.

An inner annular element 5 surrounds the periphery of the valve body 4 in a substantially median position. Such element 5 has a cylindrical shape and has a pair of holes 105 on diametrically opposite walls.

Such inner annular element 5 is provided to be fitted inside an outer annular element 6 having corresponding diametral holes 106 intended to receive a pair of pins. Such pins allow the two elements 5 and 6 to be articulated according to a diametral axis and therefore to pivot one with respect to each other relative to a median, axial transverse plane.

The outer annular element 6 is configured to be mounted on the bridge or on the dashboard of a boat at an opening, which is provided in one of the walls of said bridge or said dashboard. Said opening is intended to house the rear part of the assembly, which is composed of the valve 4 and which has a shape corresponding to the first annular element. This annular element 6 is shaped like a frame and has a substantially cylindrical shape with conical flares 206 on the walls to allow the inner annular element to tilt more. Flares are provided to house the lower part of the valve body 4 in its interference position with the inner ring 5 tilted to a maximum extent.

A clamping element 7 is interposed between the outer annular element 6 and the inner annular element 5, allowing the two annular elements to be releasably locked between a maximum negative tilt position and a maximum positive tilt position.

Figure 6:
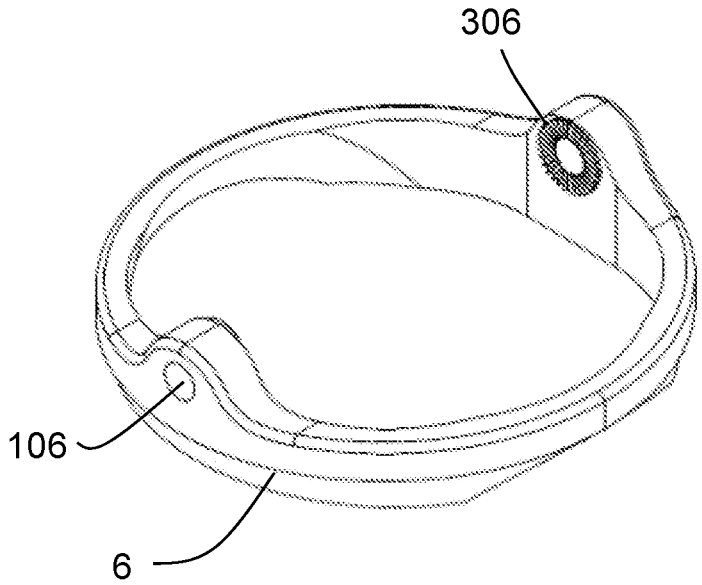
FIGS. 6 and 7 are perspective and top views respectively of the outer ring.
Figure 7:
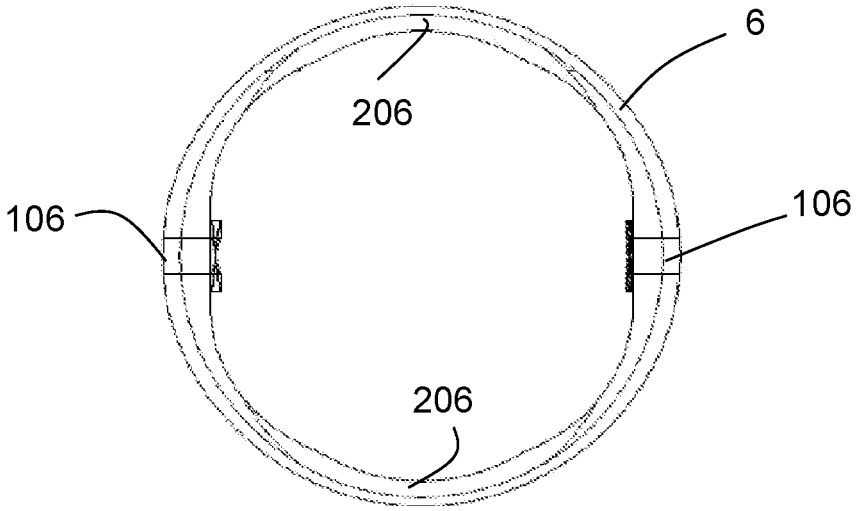

As shown in FIG. 6, one of the two holes 105 of the outer annular element 6 is surrounded by a crown of axial teeth 306 intended to abut with a corresponding crown of axial teeth surrounding the corresponding hole of the inner annular element 5 (not shown in figures). The clamping element 7 comprises a lever 107 on the pin 207 that acts on a clutch element 307 that axially moves near/away the two crowns to allow/prevent them to/from rotating. When the user needs to change the tilt, he/she turns the lever 107 to move away the two front teeth crowns from each other, releasing the two rings for a relative oscillation with respect to each other and tilts the shaft 1 of the device. By again locking the lever 107 the two rings are again locked with each other and the new position is made stable by meshing the teeth of the crowns.

It is clear that as the encumbrance of the part under the axis of rotation of the annular element is smaller, the higher is the tilt achievable by the device. To this end the inner annular element 5 is advantageously fastened in proximity of the lower part of the device. It is anyway possible to simply move upwards the oscillation/tilt axis of the two annular elements, for example by clamping the inner annular element 5 to the body of the pump 3 above the valve assembly if it is necessary to reduce the encumbrance on the bridge to detriment of a smaller tilt angle.

It has to be noted also how advantageously the annular element 6 fastened to the bridge can be slightly elongated according to an axis perpendicular to the axis of the shaft and to the tilt axis. This provides, together with conical flares on the inner edges and curved portions facing the case in the oscillation direction, for more empty space to be provided to increase tilt.

There are different possible variants that partially depend on the structure of the cases of the assemblies of drive shaft, device generating control pulses or signals and the case.

As already described hereinbefore, the second annular element 5 can be omitted and the case or the valve 4, depending on the choice and on the type of transmission member, can directly bear the pins 105, 207 that may be made as a single piece or that may be fastened, for example by being tightened in threaded holes provided in a predetermined position on the body of the case and/or of the valve 4.

Even the position locking means may be selected among a considerable number of variants that are part of the technical basic knowledge of the person skilled in the art.

Still according to an optional but advantageous improvement, at least the annular element 6 associated with the bridge can have ribs, grooves, projections or fastening seats for one end of an elastic covering dome like a sleeve or the like.

The other end can be fastened to the annular element 6 associated to the case of the control device to means coupling/fastening said elastic dome or said sleeve provided in other points of the case.

The device shown in the figures described until now is of the hydraulic type, that is, with a pump transmission member. It can be clear seen that the teaching of the present invention can be extended to any type of steering system. The idea at the base of the invention is to cause the drive shaft and together the device generating control pulses or control signals, that is, the entire steering control device, to rigidly tilt together with the drive shaft, to enable the user to tilt the steering wheel or helm without putting out of alignment or without misaligning with each other the steering wheel and the drive shaft, independently of the type of means used to convert the rotational motion of the steering drive shaft into signals or pulses activating the steering actuator.

To this end other embodiments are possible, not shown in the figures, that provide for using steering systems that comprise a mechanical, rotary or rectilinear steering system, wherein the rotation of the drive shaft causes the translation of at least one steel cable to drive a mechanical actuator or electromechanical sensors, such as potentiometers, variable capacitors or Hall effect devices, that generate electric signals uniquely associated to the angle position of the same shaft for operating an electric motor actuator, or a electro-hydraulic system where the signals generated by the steering wheel through the steering control device are converted into actions supplying pressurized fluid generated by a motorized pump to the chambers of an hydraulic actuator, or combinations thereof, such as for example the servoassisted systems described in patent application IT GE2011A000017.

All of the above without departing from the information principles disclosed above and claimed below.

The invention claimed is:

1. A steering control device for a boat comprising:

a drive shaft, a rotation of which, in one direction or in an opposite direction caused by a control member, causes a steering input for an outboard motor or rudder, said steering input being generated by a control signal or pulse generating device;

a transmission circuit enabling the control signal or pulse generating device to transmit pulses or signals generated by and corresponding to a rotation movement of the drive shaft to an actuator associated to an outboard motor, a rudder, or other units modifying a direction of a boat, wherein an assembly that includes the drive shaft and the control signal or pulse generating device is mounted to tilt about at least one axis perpendicular to an axis of rotation of the drive shaft or parallel to a bridge of the boat by at least two coaxial and diametrically opposite tilt pivots between said assembly and a structural element of the bridge; and a case housing the control signal or pulse generating device, the drive shaft protruding from the case, wherein the case is tiltable together with said assembly, the at least two diametrically opposite tilt pivots being provided between said case and said structural element of the bridge, and wherein the steering control device is provided in combination with an additional tilt member connectable on demand to the case of the assembly of the drive shaft and control pulse or signal generating device, and wherein the tilt member comprises a part adapted to be fastened to said case and a part adapted to be fastened to the structural element of the bridge, between said two parts two relative pivot points being provided in a position diametrically opposite and coaxial with each other.

2. The steering control device according to claim 1, wherein said tilt member comprises a first stationary part configured to be fastened to the bridge of the boat at an opening housing the case of the assembly of the drive shaft and control pulse or signal generating device, and a second movable part integral by being fastened to or as one piece with the case of the assembly of drive shaft and control pulse or signal generating device, said stationary and movable parts being articulated with each other to define a tilt axis for at least the drive shaft with respect to the bridge that is oriented substantially perpendicular to the axis of rotation of the drive shaft, said tilt axis being provided at an area of a rear half of the case or of an assembly composed of said case of a transmission member and of the drive shaft.

3. The steering control device according to claim 2, wherein a position of the tilt axis can be selected from at least one of the following options:

the tilt axis is provided in an area of a rear end portion of said rear half of the case or of said assembly, or the tilt axis is provided in such a position with respect to a rear side of the case or of said assembly that the rear end of the case or of said assembly protrudes into the opening of the bridge such that regions of connection of the transmission circuit or of transmission elements remain inside a space of the bridge in any tilt positions, or in two limit tilt positions, members, accesses or entrances to the control device are made accessible from outside of the bridge to allow controls or replacements/repairs.

4. The steering control device according to claim 2, wherein, in the assembly, the drive shaft, the transmission member, and the case are coupled with each other such that a change in a tilt of the shaft by a given angle causes a tilt of the transmission member to change by a same angle with a corresponding change of a tilt of the case with respect to a surface of the bridge or to another reference direction.

5. The steering control device according to claim 2, further comprising a mechanism locking in tilt position that is manually activatable or deactivatable.

6. The steering control device according to claim 2, wherein said second movable part associated to the case or to said assembly is provided as a coupling frame or ring mountable and fastenable to the case or to the assembly in a fixed or removable manner, or is at least partially made as one piece with or integrated in said assembly.

7. The steering control device according to claim 2, wherein the stationary part comprises an outer annular element configured to be fastened in a corresponding recess of a surface of the bridge, and wherein the movable part comprises an inner annular element integral with the case of the transmission member, said inner and said outer annular elements being arranged one inside the other and articulated with each other such to enable the inner annular element to tilt along a common diametric axis.

8. The steering control device according to claim 7, wherein a clamping element is interposed between the outer annular element and the inner annular element, the clamping element enabling the inner and outer annular elements to be releasably locked between a maximum negative tilt position and a maximum positive tilt position.

9. The steering control device according to claim 8, wherein the clamping element comprises a lever control member.

10. The steering control device according to claim 8, wherein the outer annular element has a first and a second diametrically opposite holes, the inner annular element having a corresponding first and second diametrically opposite holes, a first pin and a second pin being inserted in each pair of first and second holes for allowing the inner and the outer annular elements to be articulated.

11. The steering control device according to claim 10, wherein the first or the second hole of the outer annular element is surrounded by a crown of axial teeth configured to abut a corresponding crown of axial teeth surrounding the first or the second hole respectively of the inner annular element, the clamping element comprising a lever that axially moves close to or away from the two crowns to enable the two crowns to perform, or prevent the two crowns from performing, a relative rotation.

12. The steering control device according to claim 7, wherein the outer annular element has flares to enable the inner annular element to have a larger tilt, said flares receiving the case of the control member in its maximum interference position with the inner ring tilted.

13. The steering control device according to claim 7, wherein the inner annular element is fastened to the case near its lower part to limit a region arranged under the bridge when the device is mounted thereon.

14. The steering control device according to claim 7, wherein the steering control pulse or signal generating device is selected from the group consisting of:

a hydraulic device comprising a pump with a rotor, the inner annular element being fastened to a case housing the pump (3) under the rotor;

a mechanical device with bars and tie rods;

an electric or electronic device comprising electromechanical sensors for generating electric signals uniquely related to an angle position of the drive shaft, there being provided output ports for said signals to communication lines; or a electrohydraulic or electromechanical device.

15. A steering control system for a marine vessel comprising;

a tiltable steering member, a rotation of which causes a corresponding rotation of a drive shaft of a steering control device according to claim 1, the steering control device transmitting a steering input to a steering control element through a transmission circuit.

* * * * *